United States Patent [19]

Spates

[11] Patent Number: 4,864,619

[45] Date of Patent: Sep. 5, 1989

[54] STEREO HEADSET-HEADBAND ASSEMBLIES FOR HEADPHONES

[76] Inventor: G. Michael Spates, 309 Pennview Dr., Pittsburgh, Pa. 15235

[21] Appl. No.: 38,650

[22] Filed: Apr. 15, 1987

[51] Int. Cl.[4] ..... H04R 5/02

[52] U.S. Cl. ..... 381/25; 381/183; 381/187; 381/188

[58] Field of Search ..... 381/182, 25, 187, 183, 381/188; 2/172, 185 R, 199

[56] References Cited

U.S. PATENT DOCUMENTS

| | | | |
|---|---|---|---|
| 2,474,386 | 6/1949 | Volkmann | 381/187 |
| 2,810,022 | 10/1957 | Finken et al. | 381/187 |
| 3,290,450 | 12/1966 | Majoros | 381/24 |
| 3,384,719 | 5/1968 | Lanzara | 381/24 |
| 3,786,519 | 1/1974 | Aileo | 381/187 |
| 4,259,747 | 4/1981 | Taesler et al. | 381/187 |
| 4,321,433 | 3/1982 | King | 381/182 |
| 4,523,661 | 6/1985 | Scalzo et al. | 381/187 |
| 4,654,898 | 4/1987 | Ishikawa | 381/187 |
| 4,683,587 | 7/1987 | Silverman | 381/25 |
| 4,727,599 | 2/1988 | Rappaport et al. | 381/187 |
| 4,776,044 | 10/1988 | Makins | 381/187 |

*Primary Examiner*—Forester W. Isen

[57] ABSTRACT

A stereo headset-headband construction for headphones is provided of soft flexible resilient circular headband structure including a fashionable waterproof and breathable fabric having an insulating material encased therein providing thermal protection and perspiration dissipation to the wearer and a pair of headphone speakers attached to or embedded in support structure to contact the ears of a wearer.

2 Claims, 1 Drawing Sheet

STEREO HEADSET-HEADBAND ASSEMBLIES FOR HEADPHONES

FIELD OF INVENTION

The present invention relates generally to a headband assembly for stereo headphones which may be used with any stereophonic audio system including any small personal stereophonic audio system, and more particularly relates to a stereophonic headphone assembly that is primarily designed for use during outdoor recreational or sporting activities.

PRIOR ART

All or nearly all stereophonic headphones utilize a metal, plastic or other non-fabric band, normally positioned over the top of the user's head stretching from ear to ear in a configuration that is "horseshoe" shaped. However, several older examples of prior art that were reduced to practice prior to the invention of stereophonic audio reproduction, utilized unconventional headphone structures that should be noted. In this regard, reference may be made to various telephone apparatuses in U.S. Pat. Nos. 275,420; 1,329,029; 1,354,524 and 1,479,017.

The closest example of prior art to the present invention is a headband for supporting earphones that was designed for the United States Department of War and was patented in 1949; U.S. Pat. No. 2,474,386. This item of prior art was designed to effectuate the utility of supporting earphones in conjunction with the user's wearing a military helmet, and may be easily distinguished from the present invention. First, this item of prior art was not designed for stereo listening. Second, this item of prior art was not designed to be fashionable, nor was it designed to provide thermal protection. Third, as noted supra, this item of prior art was designed to be used with a military helmet, whereas the present invention claims no military utility. While this example of prior art is the closest and most approximate configuration of a headband supporting structure for headphones, this example of prior art was designed to effectuate an entirely different utility than the present invention, which is designed to effectuate a new fashionable means of providing stereophonic listening pleasure, offering thermal protection and an improved configuration for use during outdoor recreational or sporting activities.

Conventional headphones, which normally exhibit a "horseshoe" configuration, have been used in conjunction with small personal stereophonic audio systems for the private enjoyment of stereophonic sound reproduction since such audio systems were publicly introduced. However, such conventional headphones have not been aesthetically pleasing in appearance, do not provide thermal protection for the user's head and ears, nor do they absorb and dissipate the user's perspiration. In addition, conventional headphones are often uncomfortable to use and often become dislocated from the ear canal during outdoor recreational or sporting activity. Therefore, it would be highly desirable to have a headphone assembly compatible with any stereophonic audio system, including any small personal stereophonic audio system, that is fashionably designed, extremely convenient for outdoor recreational and sporting use, offers thermal protection, dissipates perspiration and is comfortable, having an elastically adjustable headband with individual Velcro adjustable headphone speakers which cannot become dislocated from the ear canal while in use. In addition, since such a headband construction for headphones normally support the headphone speakers more firmly against the user's ears than do most conventional headphones, this tends to dampen higher frequency responses while enhancing lower frequency responses as they are received by the inner ear. This produces a fuller, richer quality of stereophonic sound.

SUMMARY OF THE INVENTION

The principal objective of the present invention is to provide a novel, new and improved stereophonic headphone assembly that is extremely convenient for use during outdoor recreational and sporting activities and is compatible with any stereophonic audio system, including any small personal stereophonic audio system, or any small stereophonic audio system that may be integrated with, or attached to, the headband-headphone assembly.

A second objective of this invention is to provide an adjustable headband assembly for headphones designed to fit all sizes and shapes of heads, incorporating Velcro adjustable headphone speakers which cannot become dislocated from the ear canal during recreational or sporting activities such as walking, jogging, hiking, skiing, mountain biking or other similar activities.

A third objective of the present invention is to provide a unique headband-headphone assembly that is fashionable and comfortable, offering thermal protection for the user's head and ears while dissipating user's perspiration during recreational or sporting activities.

Briefly, the above and further objectives of the present invention are realized by providing a headband construction for headphones that is constructed with a synthetic waterproof/breathable fabric such as "Gore-Tex" or "Ultrex" with a synthetic fiberfill insulation such as "Kodofill" or "Thinsulate", or in the alternative, a construction of cotton or other natural or synthetic fabric for warmer environment applications. The headband assembly is adaptable to all shapes and sizes of heads with the incorporation of adjustable elastic material at the rear of the headband.

Incorporated and enclosed within the fabric materials that comprise the headband is a stereophonic wiring system having a male miniature or sub-miniature stereophonic electrical connector sewed into and exiting at the rear of the headband, with left and right channel wire leads exiting at the appropriate left and right ear protector locations on the inside of the headband. In addition, a small stereophonic audio reproduction system may be integrated with or attached directly to, the headband-headphone assembly. Headphone speakers are then connected to the left and right channel wiring leads at the ear protection areas, where the headphone speakers are attached to the inside of the headband with Velcro, "male" Velcro having been secured to the bases of the headphone speakers with an adhesive. The softer "female" Velcro is attached with stitching to the inside of the headband at the ear protection locations and attaches to the "male" Velcro on the bases of the headphone speakers, attaching the headphone speakers to the inside of the headband at the ear protection locations. This method of attachment of the headphone speakers to the headband permits each speaker to be individually adjusted to the proper and most comfortable locations on the user's ear.

This application of a headband construction for stereo headphones, through the use of a headband support structure and mounting device, eliminates the possibility that the headphone speakers may become dislocated from the ear canal. In addition, this headphone application provides a dramatic improvement to the listening quality of the headphone speakers as this headphone application tends to produce a dampening effect on the higher frequency responses of the headphone speakers, while having an enhancing effect on the lower frequency responses of the headphone speakers.

The present invention is designed to be compatible with any stereophonic audio system, including any small personal stereophonic audio system that uses a miniature male stereo electrical connector, normally found on conventional headphone assemblies, or in the alternative to any small stereophonic audio reproduction system that may be integrated with or directly attached to, the headband-headphone assembly. A supplemental external stereophonic wire adaptor is used to connect the male miniature or sub-miniature stereophonic electrical connector that exits at the rear of the headband assembly with the corresponding female miniature stereophonic electrical connector that is incorporated in the stereophonic audio system that is chosen to be used. As such, this supplemental external stereophonic wiring adaptor incorporates at one end ⅛" diameter miniature male stereophonic electrical connector that is compatible with the chosen stereophonic audio system. At the opposite end, the external stereophonic wiring adaptor incorporates a miniature or subminiature female stereophonic electrical connector that is compatible with the miniature or sub-miniature male stereophonic electrical connector that exits at the rear of the headband assembly. In addition, the external stereophonic wiring adaptor incorporates a dual balance volume switch that permits remote balance and volume adjustments to the left and right channel stereophonically reproduced audio signal.

Utilizing state of the art waterproof/breathable fabrics in the construction of the headband assembly, or other appealable fabrics which may include fabrics designed for warmer climates, this headband construction assembly for stereo headphones provides a new, improved and unique headphone assembly that is fashionable, aesthetically pleasing in appearance. It may be color coordinated with outdoor clothing including warm-up suits and ski clothing, adding an entirely new and novel dimension to the use of stereophonic headphones.

These and other important objectives and advantages of the present invention will be more fully understood upon a reading of the following specifications, taken in view of the attached drawings.

DESCRIPTION OF THE PREFERRED EMBODIMENT

Figure 1:
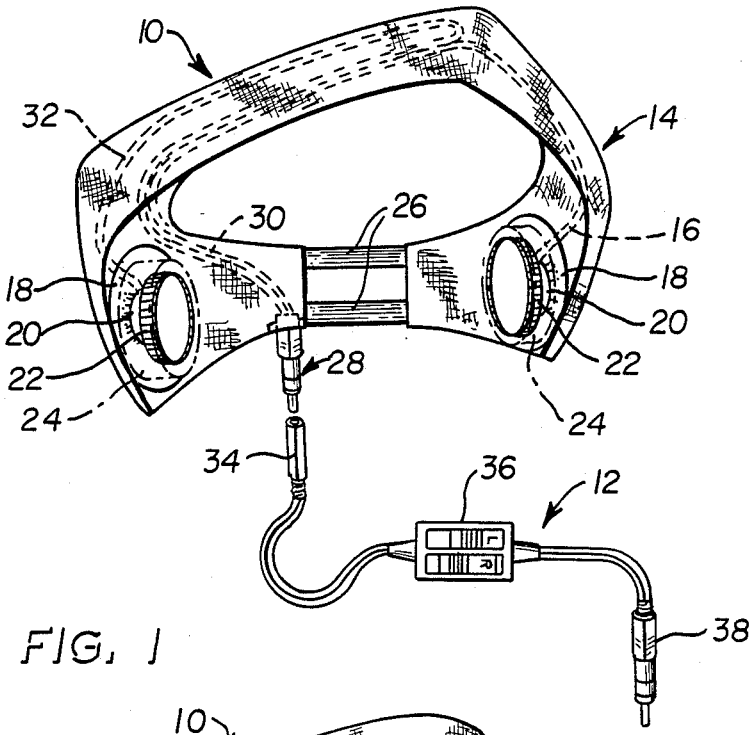
FIG. 1 is an elevational view of a headband construction for stereo headphones viewed from the front of the headband exposing both the left and right headphone speakers.
Figure 2:
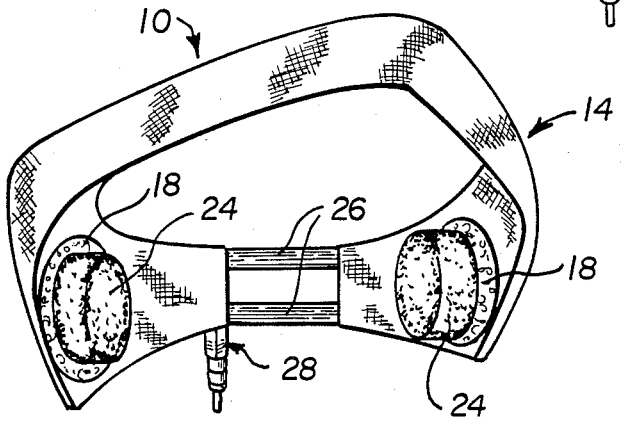
FIG. 2 is an elevational view similar to FIG. 1 showing a shaded view of the visable features of the headband-headphone assembly.

Referring the FIGS. 1 and 2, a stereo headset-headband assembly for headphones is indicated generally by the numeral 10. The headband-headphone assembly 10, which is constructed in accordance with the present invention, is designed to be electrically connected to a stereophonic audio system (not shown) with an external stereophonic wiring adaptor 12, incorporating a dual balance volume switch 36, as well as both male and female compatible electrical connectors, 38 and 34 respectively, at opposite ends of the external stereophonic wiring adaptor 12. The headband-headphone assembly 10 generally consists of a flexible circular headband 14 constructed with a waterproof/breathable fabric and a thermal synthetic fiberfill insulation, or in the alternative, any other natural or synthetic fabric construction, and is designed to encompass the circumference of the users head from ear to ear across the user's forehead. The headband-headphone assembly 10 is secured to the user's head by an elastically adjustable assembly 26 that is located at the rear of the headband 14, accomodating various sizes and shapes of heads. Left and right channel stereo headphone speakers 22, within surrounding foam rubber cushions 24, are attached to the inside of the headband 14 at the ear protection areas located on both sides of the headband 14. The headphone speakers 22 are attached to the headband 14 with Velcro, "male" Velcro 20 secured with an adhesive to the base of the headphone speakers 22, attaching to "female" Velcro 18 that is stitched onto the inside of the headband 14 at both the left and right ear protection areas. The left and right channel stereo headphone speakers 22 are electrically connected to the left and right channel stereo wire leads, 16 and 32 respectively, which extend from the integrated stereophonic wiring system 30 that is enclosed within the headband assembly 14. Exiting at the rear of the headband 14 is a miniature or sub-miniature male stereophonic electrical connector 28 that is incorporated with the integrated and enclosed stereophonic wiring system 30, connecting with the compatible miniature or sub-miniature female stereophonic electrical connector 34, located at one end of the external stereophonic wiring adaptor 12 pictured in FIG. 1. In the alternative and referring to FIG. 3, the integrated stereophonic wiring system 30 may connect with any small stereophonic audio reproduction system 40 that may be integrated with, or directly attached to, the headband-headphone assembly 10.

Considering the headband-headphone assembly 10 in greater detail, the headband assembly 14 is constructed with a synthetic waterproof/breathable fabric such as "Gore-Tex" or "Ultrex" surrounding a synthetic fiberfill insulation such as "Kodofill" or "Thinsulate", providing thermal protection for the user's head and ears and the dissipation of perspiration. In the alternative, the headband 14 may have a construction of nylon, polyester, cotton or any other natural or synthetic fabric designed for both cold and warm weather applications as well as indoor and outdoor applications. The fabric comprising the headband 14 should be of a fine quality so as to provide a fashionable and aesthetically pleasing appearance to the headband-headphone assembly 10. The Velcro method for the attachment of the stereo headphone speakers 22 to the headband assembly 14 is a unique and novel approach to securing headphone speakers to a supporting structure, permitting each headphone speaker 22 to be individually adjustable to the proper and most comfortable locations on the user's ear.

A headband-headphone assembly 10, as referred to in FIGS. 1 and 2 eliminates the possibility that the headphone speakers 22 may become dislocated from the user's ear canal since the headband-headphone assembly 10 snugly grips the user's head holding the individually adjustable headphone speakers 22 firmly in position in the proper and most comfortable location. In addition, due to the snug fit of the headband-headphone assembly 10, the headband support structure configuration for stereo headphones of the present invention provides a dramatic improvement to the listening quality of the headphone speakers 22 over most other conventional headphones, as this headband-headphone assembly 10 holds the headphone speakers 22 more firmly to the user's head, and as such, closer to the user's ear drum and inner ear. This has the effect of dampening higher frequency responses and enhancing lower frequency responses, thus improving the quality of stereo sound reproduction as perceived by the inner ear.

Figure 3:
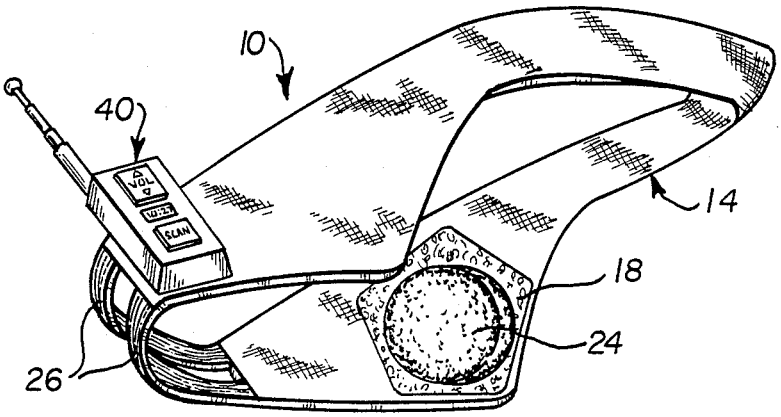
FIG. 3 is an elevational view similar to FIGS. 1 and 2 showing a shaded view of the visable features of the headband-headphone assembly including the incorporation of an attached stereophonic audio signal reproduction system.

The headband-headphone assembly 10 is compatible with any stereophonic audio system including any small personal stereophonic audio system (not shown) through the use of the compatible external stereophonic wiring adaptor 12 that is pictured in FIG. 1, or in the alternative, to any small stereophonic audio reproduction system that may be integrated with, or directly attached to, the headband-headphone assembly 10 as shown in FIG. 3. The use of an external stereophonic wiring adaptor 12 shown in FIG. 1 provides a convenient means by which to disconnect the headband-headphone assembly 10, as well as a means by which to remotely adjust both the balance and the volume of the stereophonically reproduced audio signal through the use of the dual balance volume switch 36 that is incorporated in the external stereophonic wiring adaptor 12.

As will be apparent to those skilled in the art from the foregoing description, the present invention provides a novel and useful new concept in stereophonic headphone design, of the character herein described. While the invention has been described in its preferred form with a certain degree of particularity, it is understood that the present disclosure of the preferred form has been made only by way of example. Numerous changes in the details of construction, the arrangement and types of structural components used within the invention may be resorted to without departing from the spirit and scope of the invention as hereinafter claimed. It is intended that the patent shall cover, by suitable expression in the appended claims, whatever features of patentable novelty exist in the invention disclosed.

I claim:

1. A headset-headband for surrounding a wearer's head including the forehead, ears and the back of the neck comprising:

A headband having one section formed of a soft, flexible, breathable cloth or fabric shell having an insulating fiberfill lining material encased therein, said fabric section adapted to be contoured to the wearer's head, having a narrower portion for laying over the wearer's forehead and having wider left and right contoured portions, arranged for extending over the wear's ears, leaving the top of the wearer's head exposed, and an elastic section at the rear portion of the headband connecting the left and right portions; and a pair of headphone speakers, each attached to or embedded in the wider portions of the headband, incorporating an adjustable attachment assembly comprising plastic hook and loop materials, Velcro TM, to provide for the adjustment of said headphone speakers at an inner, external side of the fabric shell of the headband, in order to align directly with the wearer's ear canal opening and directly contact the wearer's ear; and an integrated and enclosed stereo circuitry, electrically connected to said headphone speakers, which exits at the rear of the headband assembly, to be used in conjunction with any independent, or any integrated or directly attached stereo audio reproduction system.

2. A headset headband assembly comprising:

a. a contoured headband formed with a breathable, natural or synthetic fabric shell surrounding an enclosed stereo circuit and insulating fiberfill lining material, providing a resilient headband shape, thermal protection for the head and ears, perspiration dissipation and padded comfort; and b. an elastic section within said headband allowing adjustment of the size or circumference of the headband assembly; and c. headphone speakers with foam rubber ear cushions, adjustably attached at wider peripheral locations of the headband assembly, permitting said speakers to be vertically or horizontally moved, adjusted or positioned; and d. a means of headphone speaker attachment and adjustability, allowing universal, vertical and horizontal peripheral movement, positioning or adjustment of said speakers corresponding with the ear canal locations of the wearer, accomplished through the use of plastic hook and loop materials, Velcro TM, wherein plastic hook material is adhesively secured to the back of each headphone speaker and loop material is interfaced and secured to an inner, exterior side of the headband at the wider peripheral locations, and said speakers are attached and individually positioned on the wider peripheral areas of the headband by mating the plastic hook and loop materials, providing a means for symmetrical or a-symmetrical, vertical and horizontal adjustability and attachment of said speakers to the headband assembly.

* * * * *